US007237745B2

(12) United States Patent
Martinez

(10) Patent No.: US 7,237,745 B2
(45) Date of Patent: Jul. 3, 2007

(54) CONSTRUCTION WRAP APPLICATOR APPARATUS AND METHOD

(76) Inventor: Daniel Martinez, 4279 Houghton Lake Rd., E., Lake City, MI (US) 49651

( * ) Notice: Subject to any disclaimer, the term of this patent is extended or adjusted under 35 U.S.C. 154(b) by 0 days.

(21) Appl. No.: 11/273,760

(22) Filed: Nov. 15, 2005

(65) Prior Publication Data

US 2007/0108338 A1 May 17, 2007

(51) Int. Cl.
*B65H 75/28* (2006.01)

(52) U.S. Cl. ..... 242/588.2; 242/596.1

(58) Field of Classification Search ..... 242/588, 242/588.2, 596, 596.1, 596.4, 596.7, 596.8; 53/211, 556, 587; 225/46, 47
See application file for complete search history.

(56) References Cited

U.S. PATENT DOCUMENTS

| | | | | |
|---|---|---|---|---|
| 2,598,992 | A * | 6/1952 | Gordon | 242/596.1 |
| 5,667,165 | A * | 9/1997 | Gardner | 242/588.2 |
| 5,725,173 | A * | 3/1998 | Yasnogorodskiy et al. | |
| 5,738,294 | A * | 4/1998 | Yasnogorodskiy et al. | |
| 6,883,298 | B2 * | 4/2005 | Gooding et al. | 242/588.2 |

* cited by examiner

*Primary Examiner*—William A. Rivera
(74) *Attorney, Agent, or Firm*—Robert J. Sayfie, P.C.

(57) ABSTRACT

A instrument and method of applying house wrap to exterior walls. The instrument or tool or apparatus allows the roll of house wrap to be positioned with an axis of rotation substantially parallel with the wall. The house wrap can then be rolled and applied onto the wall as the apparatus is moved along the length of the wall. The apparatus can roll along an upper surface of the wall so that the apparatus need not be lifted. The apparatus also may have a guide wheel to maintain the house wrap roll at a substantially fixed distance from the wall.

20 Claims, 5 Drawing Sheets

CONSTRUCTION WRAP APPLICATOR APPARATUS AND METHOD

BACKGROUND OF THE INVENTION

This invention relates to the residential and commercial construction practice of applying "house wrap" over the sheathing. More particularly this invention is an apparatus and method to apply house wrap.

Building construction, both residential and commercial, involves the application of house wrap over the sheathing. The sheathing is usually applied on the exterior surface of an exterior wall.

Presently, this is done by manually rolling the house wrap roll along the wall to which the sheathing is applied. This sometimes involves one person on a chair or scaffolding, and one person walking along the ground, as both manually manipulate the roll of house wrap. In windy conditions the house wrap may unravel, which then takes time to replace on the roll by "reverse rolling."

As can be seen, there is a need for a tool to enable a safe and more efficient method of applying house wrap onto walls, which does not require the lifting of the wrap as it is being applied.

SUMMARY OF THE INVENTION

One aspect of the invention is a house wrap applicator apparatus, comprising: an exterior handle (20) having a first end (22) and an opposed second end (24); an upper frame (60) secured to said first end (22), said upper frame (60) extending from first end (22) to an adjustable end (64); a lower frame (70) secured to said second end (24), said lower frame (70) extending from said second end (24); an upper wrap mounting member (44) rotatably secured to said upper frame (60); and a lower wrap mounting member (48) rotatably secured to said lower frame (70), said upper wrap mounting member (44) and said lower wrap mounting member (48) capable of securing a roll of house wrap therebetween.

Another aspect of the present invention is a house wrap applicator apparatus, comprising: an exterior handle (20) having a first end (22) and an opposed second end (24); an upper frame (60) secured to said first end (22), said upper frame (60) extending from first end (22) to an adjustable end (64).

This aspect also has a lower frame (70) secured to said second end (24), said lower frame (70) extending from said second end (24); an upper wrap mounting member (44) rotatably secured to said upper frame (60); a lower wrap mounting member (48) rotatably secured to said lower frame (70), said upper wrap mounting member (44) and said lower wrap mounting member (48) capable of securing a roll of house wrap therebetween, said lower wrap mounting member (48) extending away from said lower frame (70) to a lower wrap mounting member termination portion (49); a wrap base (50) disposed between said lower frame (70) and said lower wrap mounting member termination point (49), said wrap base capable of rotatably supporting a roll of house wrap; an upper frame adjustment device (100) disposed at said adjustable end (64), said upper frame adjustment device (100) having a wall guide member (30) disposed thereto; said wall guide member (30) having a guide wheel frame (150), said guide wheel frame (150) comprising a guide wheel (38), said guide wheel (38) capable of coming in contact with an interior surface of a wall, said wall guide member (30) further having a guide bushing (34) capable of coming in contact with a top surface of a wall, said upper frame adjustment device (100), capable of biasing said guide wheel (38) towards or away from the direction of said exterior handle (20); and an interior handle (120) pivotally removably secured to said adjustable end (64).

Another aspect of the present invention is a method of applying a roll of house wrap on a wall, comprising the steps: positioning the roll of house wrap between an upper frame and a lower frame, and further positioning the roll of house wrap between and exterior handle and the wall; applying portion of the house wrap onto the wall; moving said roll of house wrap relative to said wall; and applying a further portion of the house wrap onto the wall.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to e taken in a limiting sense, but is made merely for the purpose of illustrating the general principles of the invention, since the scope of the invention is best defined by the appended claims.

Figure 1:
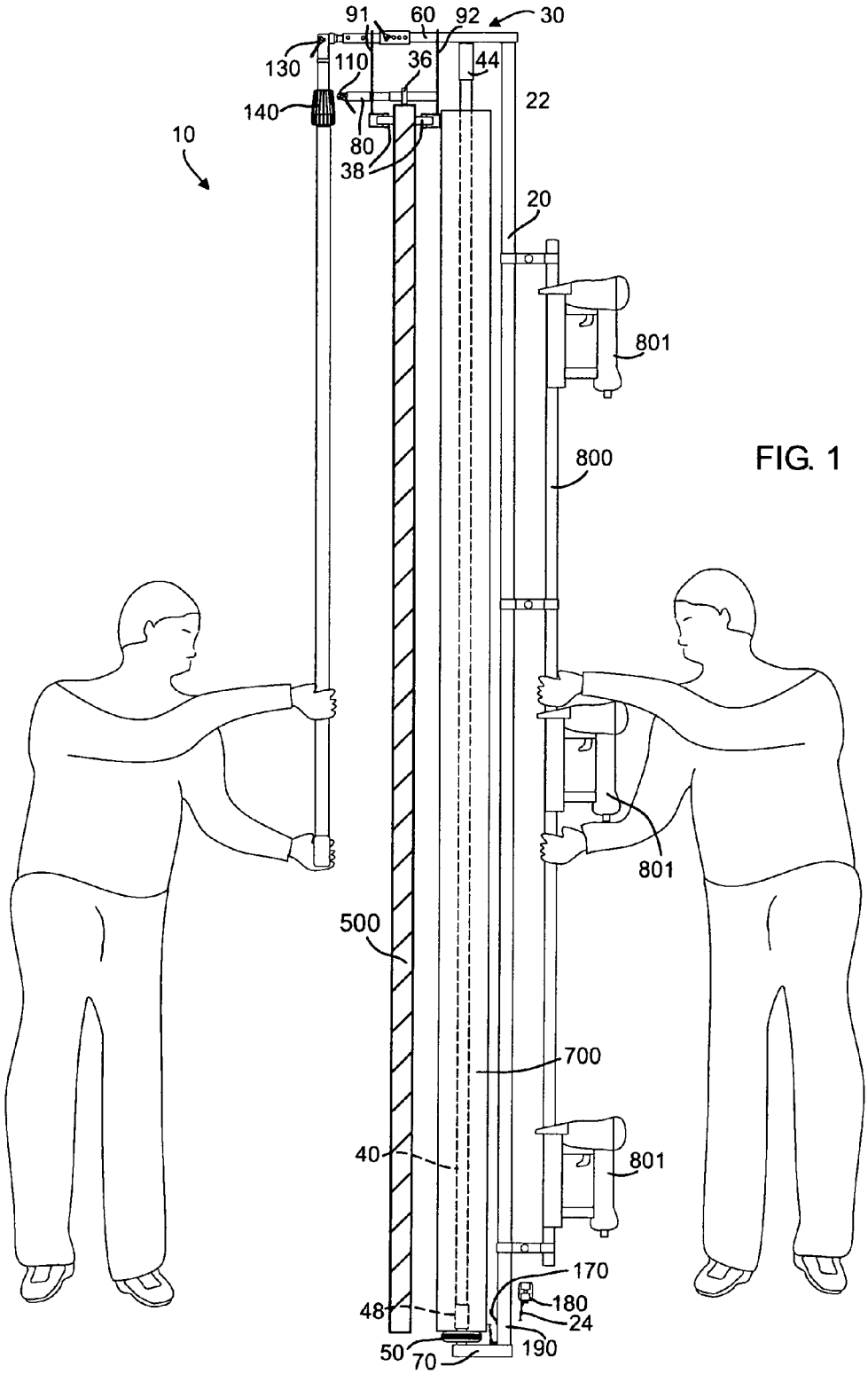
FIG. 1 is a pictorial of the apparatus.

FIG. 1 illustrates a house wrap applicator apparatus and method 10. The present invention may be used by two people as illustrated in FIG. 1. The wall 500 may be a wall of a residential or commercial building under construction. A roll of house wrap or construction wrap 700 may be secured between an upper wrap mounting member 44 and a lower wrap mounting member 48. A person standing on what may be the exterior surface of the wall will move the construction wrap applicator apparatus and method 10 relative to the wall 500. The house wrap 700 may rotate while it is secured between the upper wrap mounting member 44 and the lower wrap mounting member 48. The upper wrap mounting member 44 is rotatably secured to an upper frame 60. The lower wrap mounting member 48 is rotatably secured to a lower frame 70. An exterior handle 20 has a first end 22 that is secured to the upper frame, and a second end 24 that is secured to the lower frame. The exterior handle 20 is adjacent to the wrap mounting members 44, 48. The house wrap 700 may rest on a wrap base 50 that rotates freely so the house wrap can be applied. The wrap base 50 is rotatably secured to the lower frame 70. In one exemplary embodiment of the present invention, the wrap base 50 is concentrically disposed with respect to the lower wrap mounting member 48. As further illustrated in FIG. 1, an upper frame adjustment device 100 is disposed thereon. The exterior handle 20, and the wrap holder 40 may also be adjustable to accommodate for walls of different heights, and for house wrap rolls 700 of different heights.

Figure 2:
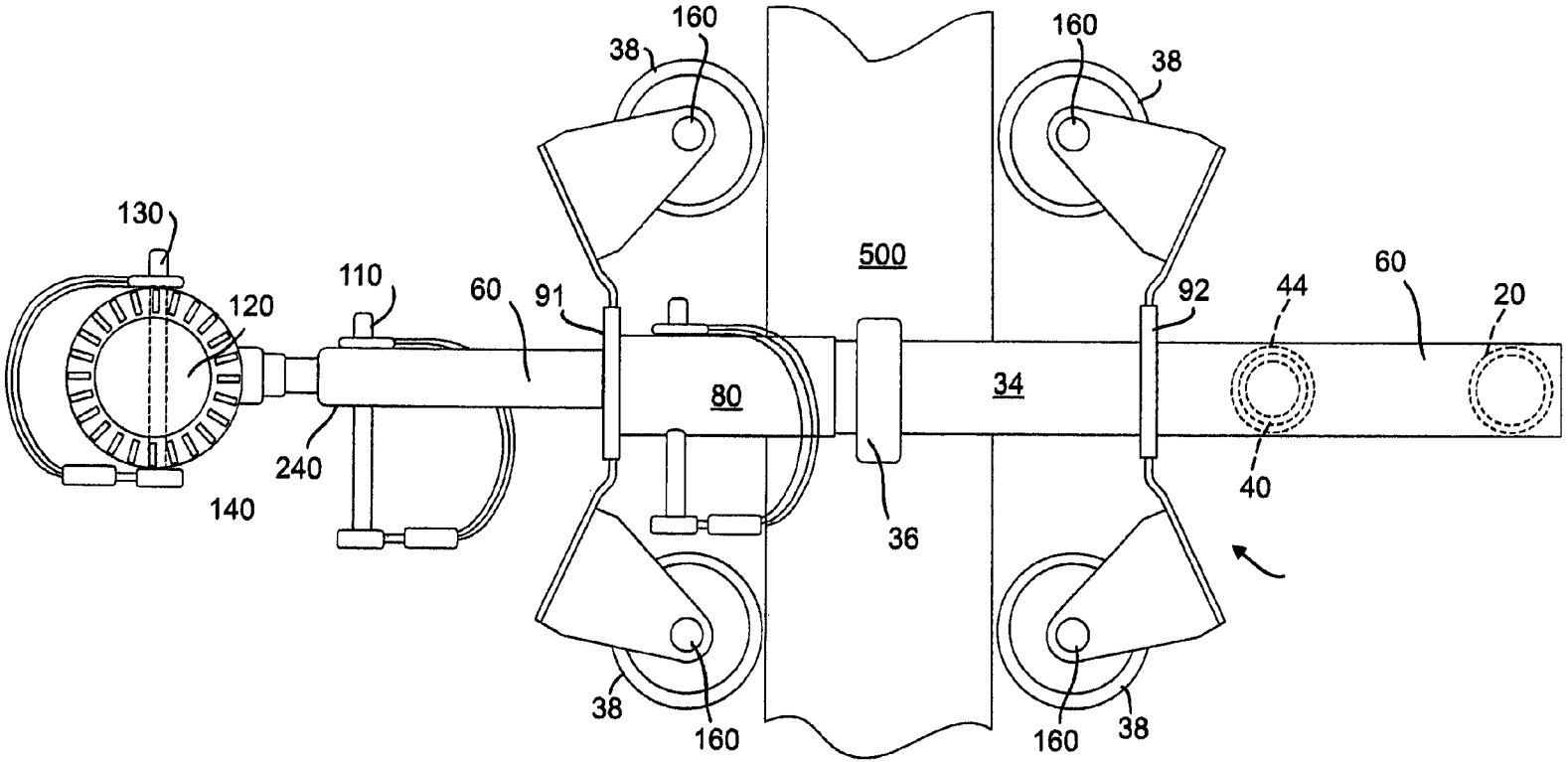
FIG. 2 is a top view of the apparatus.

FIG. 2 is a top view of the present invention. The upper frame 60 has a guide bushing 34 that rotates about a longitudinal axis (not shown) relative to the upper frame 60. The guide bushing 34 may be rotatably secured to an upper frame member 240. The guide bushing 34 may roll on the wall's 500 upper surface so that the house wrap 700 does not have to be lifted while it is being applied to the wall 500. The guide wheels 38 are also illustrated. The upper frame adjustment device 100 enables the guide wheel(s) to be positioned and re-positioned at varied distances relative to the upper wrap mounting member 44. These guide wheels 38 may guide the movement of the apparatus by contacting an inside surface of the wall 500 so that the wrap 700 is fixed at a substantially constant distance from the wall while being applied 500. This allows the present invention to be used on walls 500 of varied thickness. A spacer wheel 36 may be concentrically disposed between the guide bushing 34 and a spacer 220. The spacer 220 being disposed between the guide bushing 36 and the upper frame 60. In one exemplary embodiment, a locking pin 100 with locking frame apertures 102 may be used to securely re-position the guide wheel 38 at varied distances from the wrap holder 40. An extension bushing 80 may be stored on the upper frame member 240, whereby it 80 can be removed from this storage location—as shown in FIG. 2—to be placed immediately next to the guide bushing 34, as the guide wheel 48 is repositioned to be further away from the wrap holder 40 via the upper frame adjustment device 100. The extension bushing 80 may be removed by removal of the bushing locking device 110. In one exemplary embodiment, the bushing locking device 110 is a locking pin 110 with pin holes (not shown) that are disposed in the upper frame member 240. With reference to FIG. 2, leftwardly of the bushing locking device 110 is the interior handle 120. In one exemplary embodiment, the interior handle 120 may pivot via a interior handle pivot member 130. The interior handle 120 may be entirely removed from the upper frame 60 via the interior handle pivot member 130, or it 120 may be partially removed via the interior handle detachment device 140.

Figure 3:
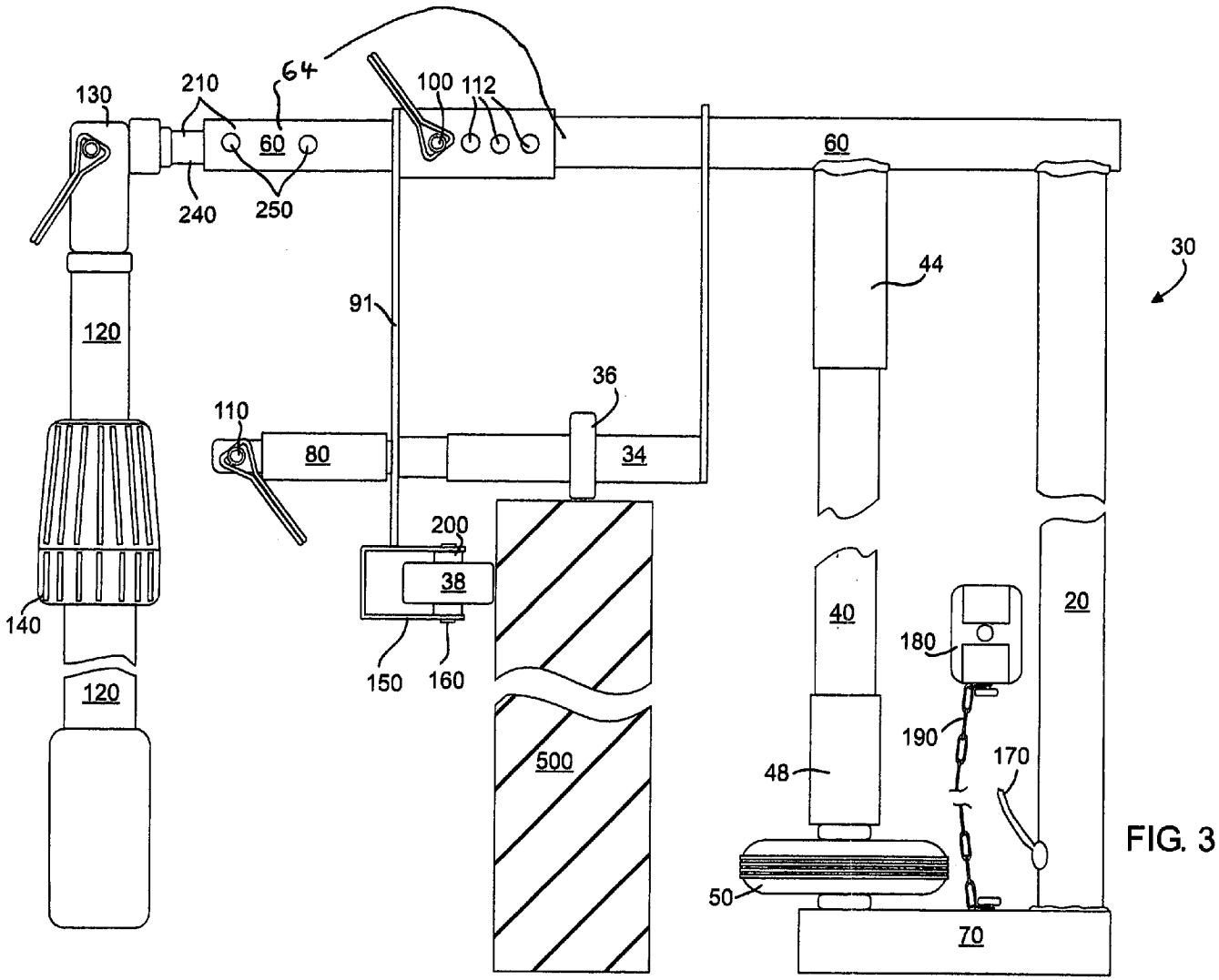
FIG. 3 is a sectional view from line 2-2 of FIG. 2.

FIG. 3 illustrates a cross sectional view of line 2-2 of FIG. 2. Interior handle telescoping arms 210 allow the interior handle 120 to be positioned and re-positioned via a locking pin (not shown) that can be adjustably placed through the holes 250. A wrap retainer 180 may be stored on a hook 170 when not in use. When in use, the wrap retainer 180 may be applied to the wrap to secure it in windy conditions. The wrap retainer 180 is secured by a wrap retainer securing device 190. In one exemplary embodiment the wrap retainer securing device 190 is a chain. The wrap retainer 180 may have an aperture 182 in which a fastener may be driven into the house wrap 700 into the wall 500.

Figure 4:
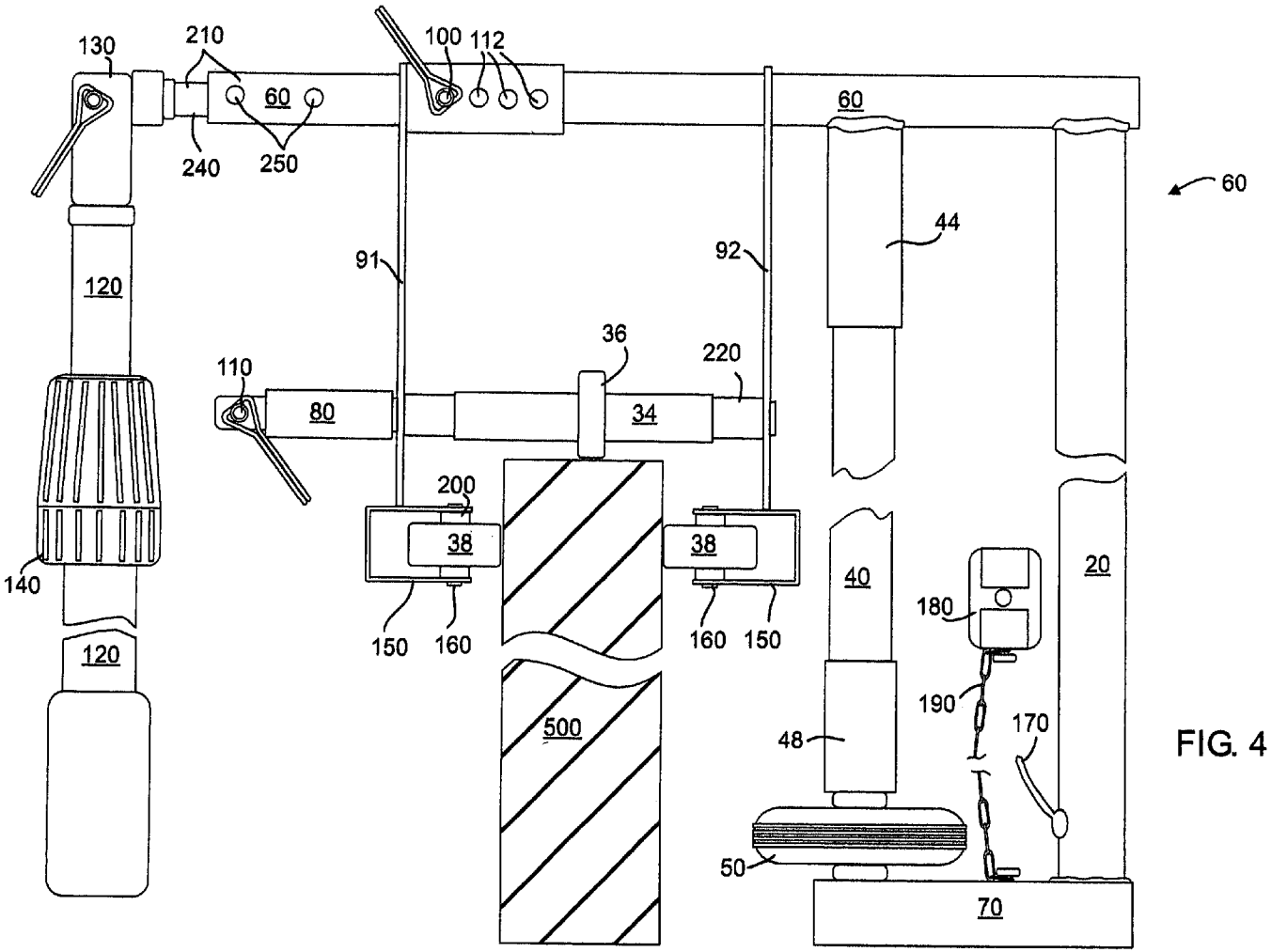
FIG. 4 is a view similar to FIG. 3, but having two guides wheels and struts.

FIG. 4 illustrates an exemplary embodiment of the present invention having two guidewheels 38 and supporting struts 91. Other than that, the other components may be similar to those described in FIG. 3. This dual guidewheel 38 configuration may provide better stability than the exemplary embodiment as illustrated in FIG. 3. A spacer 220 may be disposed between the second strut 92 and the rotatable guidewheel 38.

Figure 5A:
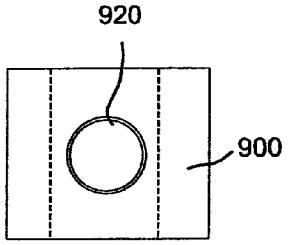
FIGS. 5A and 5B is a view of the bracket.
Figure 5B:
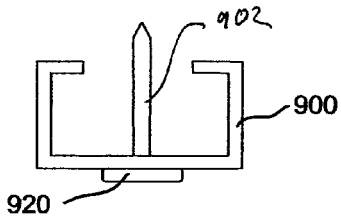

FIGS. 5A and 5B illustrate the modified bracket 900 and the modified bracket aperture 920. A fastener 902 is shown in FIG. 5B.

Figure 6:
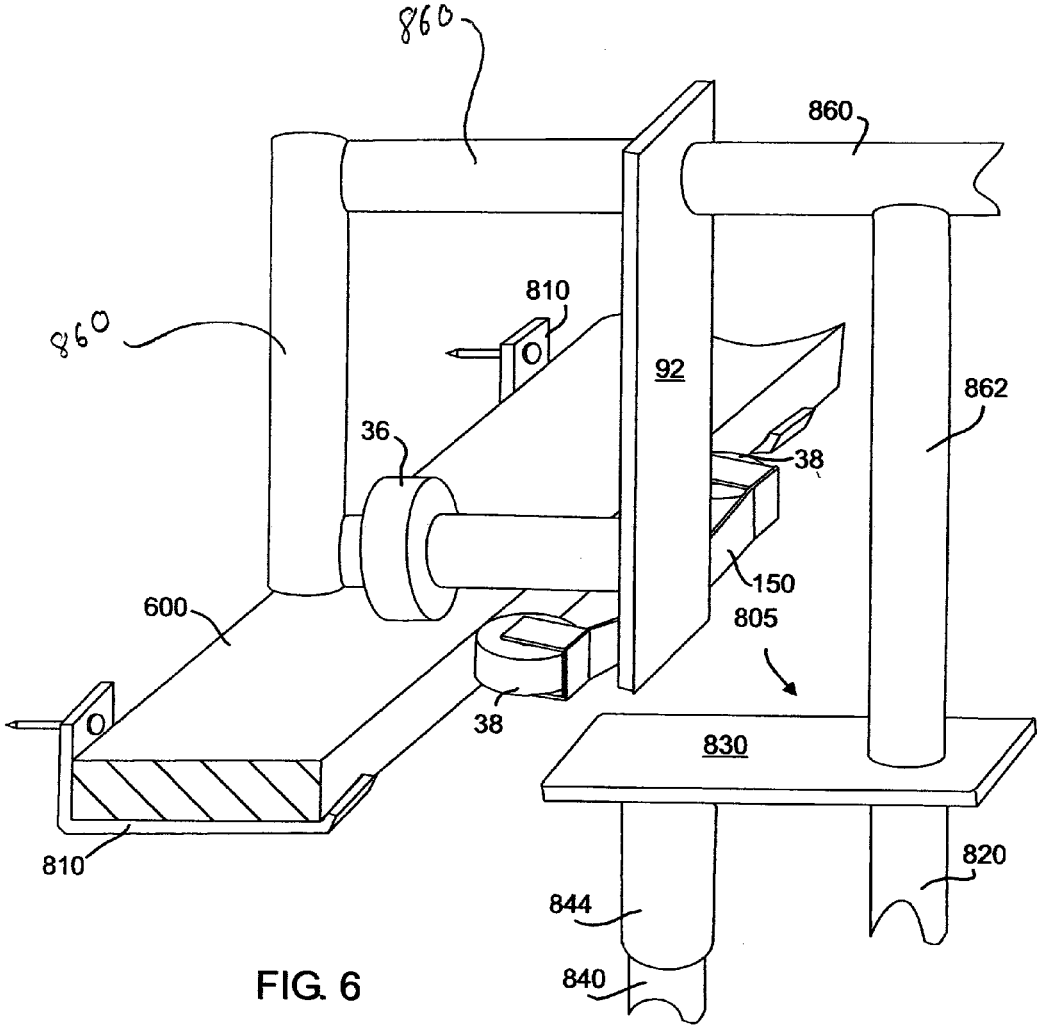
FIG. 6 is a pictorial of an embodiment of the present invention using a bracket if the wall already has a roof on it.

FIG. 6 is another exemplary embodiment of the present invention. This embodiment may be used where a roof is already assembled to the wall (not illustrated in FIG. 6), or in other circumstances whereby a user cannot be on the "inside" of the wall to hold the interior handle 120. Here the assembly may have a modified upper frame 860 secured to a modified first handle end 862 and strut 92, similar to the other exemplary embodiments as illustrated in FIG. 14. In this case the guide wheel 38 may roll on a plank 600, which may be secured to a wall via a bracket 810. This embodiment may also have a modified first handle end 862 that extends downwardly to a horizontal member 830. This horizontal member 830 may have a modified upper wrap mounting member 844 extending downwardly therefrom. The horizontal member 830 may have a modified exterior handle 820 extending downwardly therefrom. The modified upper wrap mounting member 844 and the modified exterior handle 820 may have a similar construction and operation as the upper wrap mounting member 44 and the exterior handle 20, as illustrated in FIGS. 1-4. FIG. 6 also illustrates the guidewheel 38, and its capability of being guided along the side of a plank 600, such as a 2×4.

FIG. 1 also illustrates an embodiment having an accessory extension handle 800 pivotally connected to the exterior handle 20, whereby the accessory extension handle 800 pivots at its 800 juncture with the exterior handle 20, which allows an accessory 801, such as an air gun or nail gun. In operation, after applying the house wrap, the accessory extension handle may be moved in proximity with the house wrap to fire the nail gun, securing the house wrap to the wall.

It should be understood, of course, that the foregoing relates to exemplary embodiments of the invention and that modifications may be made without departing from the spirit and scope of the invention as set forth in the following claims.

I claim:

1. A house wrap applicator apparatus, comprising:

an exterior handle having a first end and an opposed second end;

an upper frame secured to said first end, said upper frame extending from first end to an adjustable end;

said upper frame has a guide bushing that rotates about a longitudinal axis relative to the upper frame, said guide bushing capable of rolling on a wall;

a lower frame secured to said second end, said lower frame extending from said second end;

an upper wrap mounting member rotatably secured to said upper frame; and a lower wrap mounting member rotatably secured to said lower frame, said upper wrap mounting member and said lower wrap mounting member capable of securing a roll of house wrap therebetween.

2. A house wrap applicator apparatus, comprising:

an exterior handle (20) having a first end (22) and an opposed second end (24);

an upper frame (60) secured to said first end (22), said upper frame (60) extending from first end (22) to an adjustable end (64);

a lower frame (70) secured to said second end (24), said lower frame (70) extending from said second end (24);

an upper wrap mounting member (44) rotatably secured to said upper frame (60);

a lower wrap mounting member (48) rotatably secured to said lower frame (70), said upper wrap mounting member (44) and said lower wrap mounting member (48) capable of securing a roll of house wrap therebetween, said lower wrap mounting member (48) extending away from said lower frame (70) to a lower wrap mounting member termination portion (49);

a wrap base (50) disposed between said lower frame (70) and said lower wrap mounting member termination point (49), said wrap base capable of rotatably supporting a roll of house wrap;

an upper frame adjustment device (100) disposed at said adjustable end (64), said upper frame adjustment device (100) having a wall guide member (30) disposed thereto; said wall guide member (30) having a guide wheel frame (150), said guide wheel frame (150) comprising a guide wheel (38), said guide wheel (38) capable of coming in contact with an interior surface of a wall, said wall guide member (30) further having a guide bushing (34) capable of coming in contact with a top surface of a wall, said upper frame adjustment device (100), capable of biasing said guide wheel (38) towards or away from the direction of said exterior handle (20); and an interior handle (120) pivotally removably secured to said adjustable end (64).

3. The apparatus of claim 2, wherein said upper frame adjustment device (100) comprises a fixed arm (106) and a sliding arm (108) that concentrically surrounds said fixed arm (106) and is capable of sliding relative to said fixed arm (106). Said fixed arm (106) and said sliding arm (108) having apertures (102) disposed about 180° apart so the apertures (102) may receive a locking pin (104) to lock said sliding arm (108) relative to said fixed arm (106).

4. The apparatus of claim 2, wherein said upper frame adjustment device (100) further comprises a first strut (91) extending from said upper frame (60) to said guide wheel frame (150), said upper frame adjustment device (100) also comprising a second strut (92) extending from said upper frame (60) to said guide bushing (34).

5. The apparatus of claim 2, wherein said guide bushing (34) is rotatably secured around a dowel (not shown) and disposed between said first strut (91) and said second strut (92), and further comprising an extension bushing (80) that can be disposed around said dowel (not shown) disposed between said first strut (91) and a bushing locking device (110), said extension bushing (80) capable of being moved to a position on said dowel (not shown) between said first strut (91) and said second strut (92) to reposition said guide wheel (38) away from said handle (20).

6. The apparatus of claim 2, further comprising an interior handle detachment device (140) to enable the removal of said interior handle (120) from said upper frame (60).

7. The apparatus of claim 2, further comprising interior handle telescoping arms (210) with mating apertures to receive a locking member therethrough to lock one telescoping arm (210) relative to the other telescoping arm (210).

8. The apparatus of claim 2 further comprising said interior handle (120) having a locking pin (130) disposed through a respective aperture near said upper frame (60) whereby said handle (120) can be removed my removing said locking pin (130), and whereby said handle (120) can pivot about said locking pin (130).

9. The apparatus of claim 2, further comprising a wrap holder (40) detachably secured between said upper wrap mounting member (44) and said lower wrap mounting member (48), whereby a house wrap roll may be slid around said wrap holder (40) whereby the house wrap roll may roll relative to a wall during use.

10. The apparatus of claim 2, further comprising a spacer (220) disposed between said second strut (92) and said guide bushing (34).

11. The apparatus of claim 2, wherein said guide wheel frame (150) is c-shaped and further comprising a guide wheel axle (200) disposed between said guide wheel frame (150) to rollably secure said guide wheel (38).

12. The apparatus of claim 2, further comprising a hook (170) to receive a wrap retainer (180), said wrap retainer (180) secured to said lower frame (70) via a wrap retainer securing device (190).

13. The apparatus of claim 2, further comprising an accessory extension handle that is pivotally connected to the exterior handle.

14. The apparatus of claim 13, further comprising an accessory secured to said accessory extension handle.

15. The apparatus of claim 2, further comprising another guide wheel frame having a guide wheel capable of coming in contact with an exterior surface of the wall.

16. A house wrap applicator apparatus, comprising:

a modified exterior handle (820) having a first end and an opposed second end;

a modified upper frame (860) secured to said first end, said modified upper frame (860) extending from first end to an adjustable end;

a lower frame (70) secured to said second end, said lower frame (70) extending from said second end;

a modified upper wrap mounting member (844) rotatably secured to a horizontal member (830) that is secured to a modified first handle end (862), said modified first handle end (862) being secured to said modified upper frame (860);

a lower wrap mounting member rotatably secured to said lower frame, said upper wrap mounting member (844) and said lower wrap mounting member capable of securing a roll of house wrap therebetween, said lower wrap mounting member extending away from said lower frame to a lower wrap mounting member termination portion;

a wrap base disposed between said lower frame and said lower wrap mounting member termination point, said wrap base capable of rotatably supporting a roll of house wrap;

an upper frame adjustment device (100) disposed at said adjustable end (64), said upper frame adjustment device (100) having a wall guide member (30) disposed thereto; said wall guide member (30) having a guide wheel frame (150), said guide wheel frame (150) comprising a guide wheel (38), said guide wheel (38) capable of coming in contact with an interior surface of a wall, said wall guide member (30) further having a rotatable member (34), (36) capable of coming in contact with a top surface of a wall, said upper frame adjustment device (100), capable of biasing said guide wheel (38) towards or away from the direction of said exterior handle (20); and a spacer wheel (36) rotatably secured between said strut (92) and said modified upper frame (860), said spacer wheel (36) capable of coming in rotatable contact with a plank (600) top surface.

17. The house wrap applicator apparatus of claim 16, further comprising a guide wheel frame (150) capable of coming in rotatable contact with a plank (600) surface.

18. The house wrap applicator apparatus of claim 16, further comprising a bracket (810) that can be secured to a wall and said bracket (810) may be used to hold a plank (600), whereby said spacer wheel (36) may roll on a plank (600) top surface.

19. The apparatus of claim 16, further comprising a hook (170) to receive a wrap retainer (180), said wrap retainer (180) secured to said lower frame (70) via a wrap retainer securing device (190).

20. The apparatus of claim 16, further comprising an accessory extension handle that is pivotally connected to the exterior handle, said accessory extension handle adaptable to hold an accessory.

* * * * *